United States Patent [19]

Nishimura

[11] Patent Number: 4,681,460

[45] Date of Patent: Jul. 21, 1987

[54] WORLD TIME WATCH

[75] Inventor: Katsuo Nishimura, Tokorozawa, Japan

[73] Assignee: Citizen Watch Co., Ltd., Tokyo, Japan

[21] Appl. No.: 906,331

[22] Filed: Sep. 12, 1986

[30] Foreign Application Priority Data

Sep. 13, 1985 [JP] Japan ..... 60-202793
Oct. 15, 1985 [JP] Japan ..... 60-229171

[51] Int. Cl.[4] ..... G04B 19/22
[52] U.S. Cl. ..... 368/21; 368/22
[58] Field of Search ..... 368/21–24

[56] References Cited

U.S. PATENT DOCUMENTS 2,299,913 10/1942 Clough ..... 368/21
3,002,337 10/1961 Smith ..... 368/21
3,940,920 3/1976 Nakamura et al. ..... 368/21
4,316,272 2/1982 Naito ..... 368/21

*Primary Examiner*—Bernard Roskoski
*Attorney, Agent, or Firm*—Birch, Stewart, Kolasch & Birch

[57] ABSTRACT

A world time watch has a liquid crystal display device including a time zone display and a time display. The time zone display is provided to display the time difference between a selected place and the Greenwich Mean Time, and the time display is provided to display the time of the place corresponding to the time difference displayed in the time zone display. A printed place name list is provided around the liquid crystal display device. The place name list includes a plurality of numbers each of which represents the corresponding time difference of a particular place.

5 Claims, 8 Drawing Figures

WORLD TIME WATCH

BACKGROUND OF THE INVENTION

The present invention relates to a world time watches and more particularly to a portable world time watch displaying times of at least two time zones of the world.

A world time watch displaying the times of various areas of the world has been disclosed. A world time watch comprising a world map having marks representing time zones and a liquid crystal display device is disclosed in Japanese Patent Publication No. 52-24870. The time of a selected area and a mark for the selected area are indicated on the display device. However, in order to exactly indicate the times of various areas, a large world map is required, which means the size of the watch must be increased.

Further, there has been disclosed a portable type world time watch in which the time of a desired place is displayed on a single display panel by operating a changeover button. Therefore, the times of two or more areas cannot be displayed at the same time.

SUMMARY OF THE INVENTION

An object of the present invention is to provide a world time watch which may eliminate the above described disadvantages.

Another object of the present invention is to provide a portable world time watch which can indicate the times of at least two areas of the world.

According to the present invention, a world time watch has a liquid crystal display device including a time zone display, a time display and a principal city time display. The time zone display is provided to display the time difference between a selected place and the Greewich Mean Time, and the time display is provided to display the time of the difference place corresponding to the difference displayed in the time zone display. The world time watch further has a printed place name list including a plurality of place names and a plurality of numbers each of which represents the time difference of a corresponding place, and a printed world map having city names. The place name list is provided around the liquid crystal display device.

These and other objects and features of the present invention will become more apparent from the following description with reference to the accompanying drawings.

DESCRIPTION OF THE PREFERRED EMBODIMENTS

Figure 1:
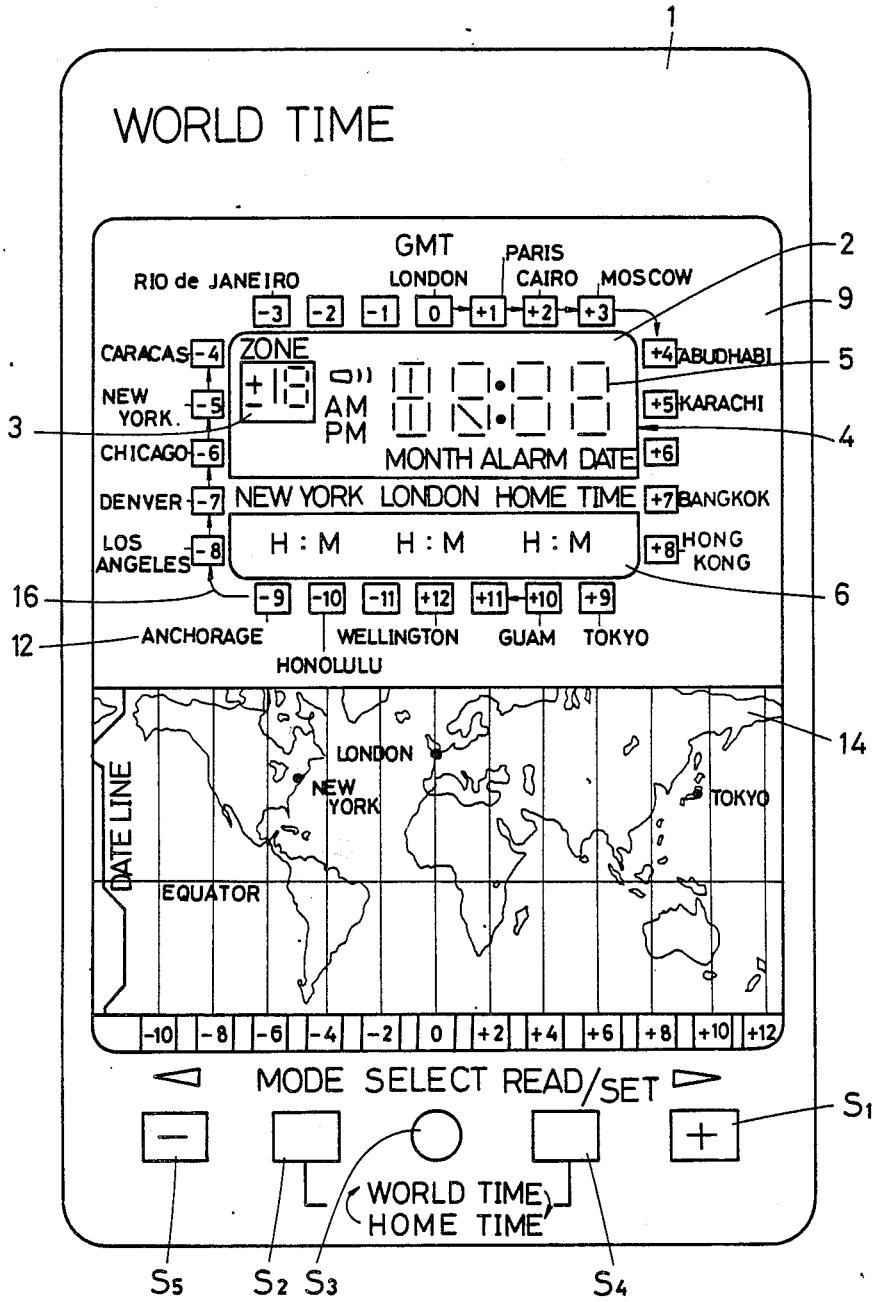
FIG. 1 is a plan view of a portable type world time watch according to the present invention.

Referring to FIG. 1, a world time watch 1 has a board 9 on which a liquid crystal display device 2 comprising a world time display panel 4 and a principal city time display panel 6 adjacent to the lower side of the display panel 4 is provided. A world map 14 is printed on the board 9 at a lower portion of the board. A plurality of switch buttons S1 to S5 are disposed on a lower portion of the watch 1. A place name list 12 comprising successive numbers (digits) and a plurality of place and city names of the world is disposed around the outer periphery of the liquid crystal display device 2. Each of the numbers represents the time difference between the GMT (Greenwich Mean Time) and the standard time of the selected place with a plus or a minus sign. That is, as the GMT is 0, respective numbers are indicated such as 0, +1, +2, +3, . . . +11, +12, −11, −10 . . . −2, −1 at every time zone. Typical place name or city name in each time zone is printed adjacent the corresponding number. The world time display panel 4 has a time zone display 3 provided at the left thereof for selectively indicating the time difference. A time display 5 of the world time display panel 4 displays the time of the time zone displayed in the time zone display 3 and is adapted to selectively indicate a day of the week and a date of the displayed time zone (a selected city) by a switch button operation. The principal city time display panel 6 always displays the times of NEW YORK, LONDON, and home city, respectively. However, the time display of HOME TIME is selectively displayed as will be hereinafter described.

The world map 14 is provided with lines of east longitude and west longitude at every 30° C., the equator, the dateline, and city names printed thereon. On the lower portion of the map 14, corresponding to each longitude, the time difference is written such as +2, +4, . . . +12, −4, . . . −10.Therefore, as will be described hereinafter, when the user wants to know the time, for example the time of the east coast of Australia, he finds that the time-difference at the place is +10 from the map 14. Then, the indication of +10 is displayed in the time zone display 3 by operating a switch button, so that a corresponding time of the time zone is displayed in the time display 5.

The switch buttons are a time-difference increasing button S1, mode select button S2, figure select button S3, calendar display/correction button S4, and time-difference decreasing button S5.

Figure 2:
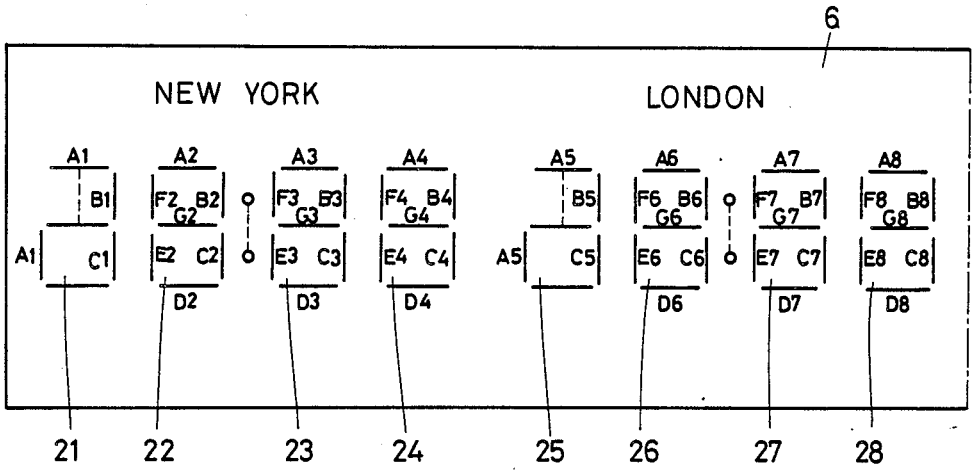
FIG. 2 is a schematic plan view of a liquid crystal display panel used in the watch.

Referring to FIG. 2 showing liquid crystal display panel 6 for NEW YORK and LONDON, each time display comprises four numerical patterns. Four patterns under the character NEW YORK comprise a first pattern 21 having three segments of A1, B1 and C1 to form digits "1" and "2", and a second pattern 22, a third pattern 23, and a fourth pattern 24 each having seven segments of A, B, C, D, E, F, and G to form all digits from "0" to "9". The first and second patterns 21 and 22 are adapted to indicate the hour of NEW YORK, and the third and fourth patterns 23 and 24 indicate the minute thereof. A series of four patterns under the character of LONDON has the same structure that of NEW YORK namely, a fifth pattern 25, sixth pattern 26, seventh pattern 27 and eighth pattern 28. The fifth and sixth patterns 25 and 26 indicate the hour of LONDON, and the seventh and eighth patterns 27 and 28 indicate the minute thereof.

Describing the display of the time of each city, the time-difference between the GMT and NEW YORK is −5 hours and that of LONDON from the GMT is zero. When th GMT is at 1258 hours, the time of NEW YORK is at 0758 hours. Thus, the first pattern is not energized. (Although the liquid crystal display device is a device of a non-light emitting type, when the segments are excited, it is referred to as "a segment is lighted" as a matter of convenience). In the second pattern 22, segments A2, B2 and C2 are energized to form digit "7". In the third pattern 23, segments A3, C3, D3, F3 and G3 are lighted to form digit "5". All segments from A4 to G4 of fourth pattern 24 are energized to form digit "8". In the fifth pattern 25, segments B5 and C5 are energized to form digit "1". In the sixth pattern 26, segments A6, B6, D6, E6 and G6 are lighted to form "2". Segments A7, C7, D7, F7 and G7 in the seventh pattern 27 are lighted to form "5". In the eighth pattern 28, all segments from A8 to G8 are energized to form "8".

As time goes by, the first pattern 21 and second pattern 22 indicate the hour of NEW YORK always keeping the time-difference of −5 hours from the hour of LONDON indicated by the fifth pattern 25 and sixth pattern 26. While, the third pattern 23 and fourth pattern 24 for displaying the minute of NEW YORK are always driven in synchronism with the seventh pattern 27 and eighth pattern 28 of the minute display of LONDON, displaying the same value as LONDON.

Figure 3:
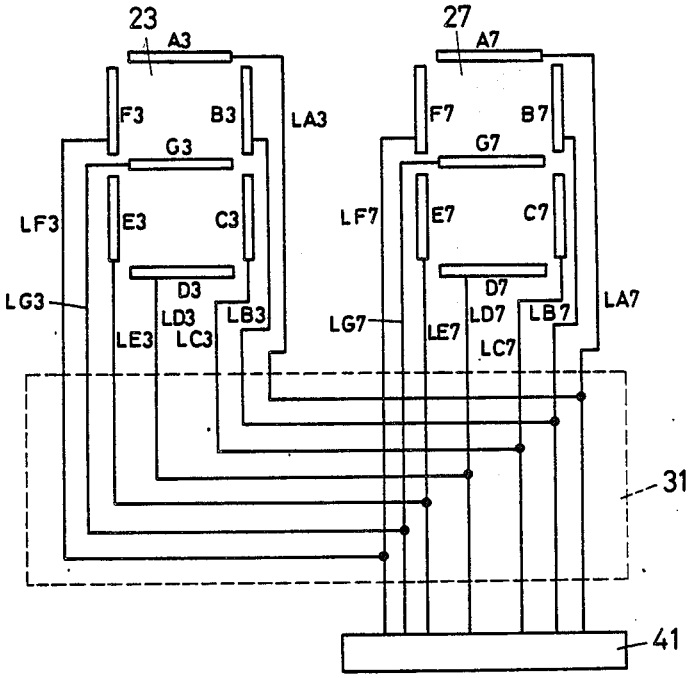
FIG. 3 is an enlarged schematic plan view showing a part of patterns of FIG. 2.

FIG. 3 shows the third pattern 23 and the seventh pattern 27 driven by static drive. A lead LA3 electrically connected with the segment A3 of the third pattern 23 is electrically connected to a lead LA7 of the segment A7 of the seventh pattern 27 at a through-hole of a double-sided circuit board 31. Similarly, other leads LB3 and LB7, LC3 and LC7, LD3 and LD7, LE3, and LE7, LF3 and LF7, and LG3 and LG7 are electrically connected on the circuit board 31. Then, the leads are connected to a driving circuit 41. Accordingly, number of the drivers in the circuit 41 is reduced in half compared with that of a conventional driving circuit. That is, although fourteen drivers are conventionally required, seven drivers are provided in the circuit 41.

In the same manner, leads of segments A4 to G4 of the fourth pattern 24 are electrically connected to corresponding leads of segmetns A8 to G8 of the eighth pattern 28 on the circuit board 31.

Figure 4:
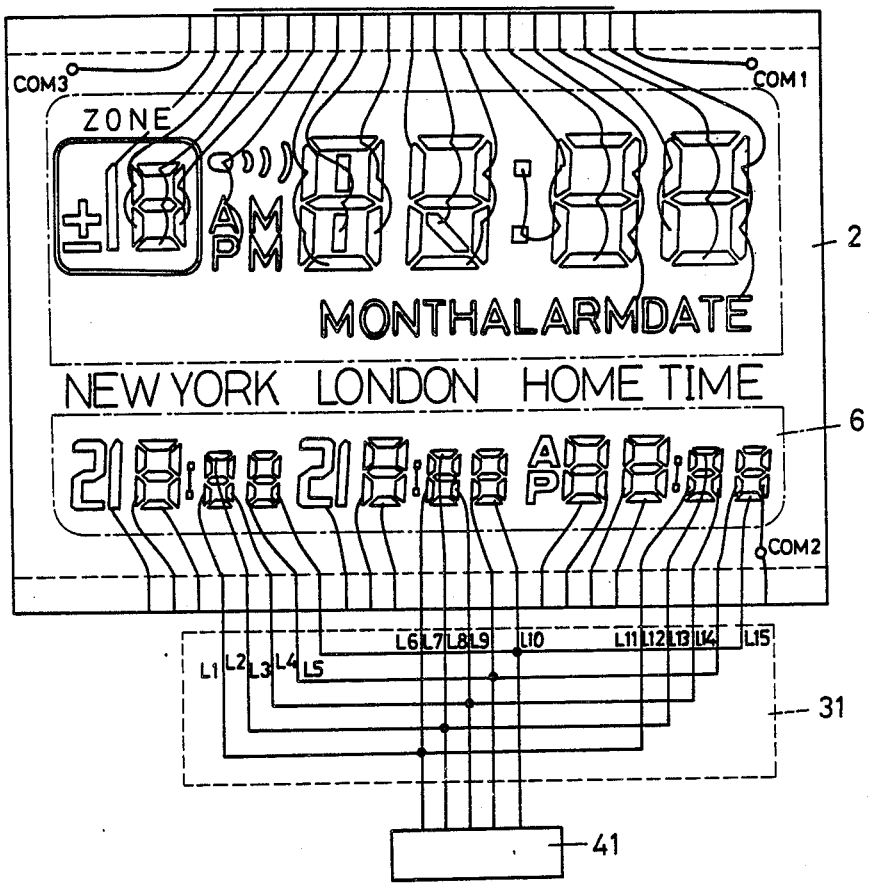
FIG. 4 is an enlarged plan view of a display panel of FIG. 1.

Referring to FIG. 4, each of the numerical patterns for indicating the minute of respective cities, that is NEW YORK, LONDON, and HOME TIME, provided in the principal city time display panel 6 are connected by five leads and driven by a matrix drive, respectively. Two patterns of the minute display for NEW YORK are connected by leads L1, L2, L3, L4 and L5, two patterns of LONDON are connected by leads L6, L7, L8, L9 and L10, and those of HOME TIME are connected by leads L11, L12, L13, L14 and L15 with each other and connected to driving circuit 41 by common leads.

Figure 5:
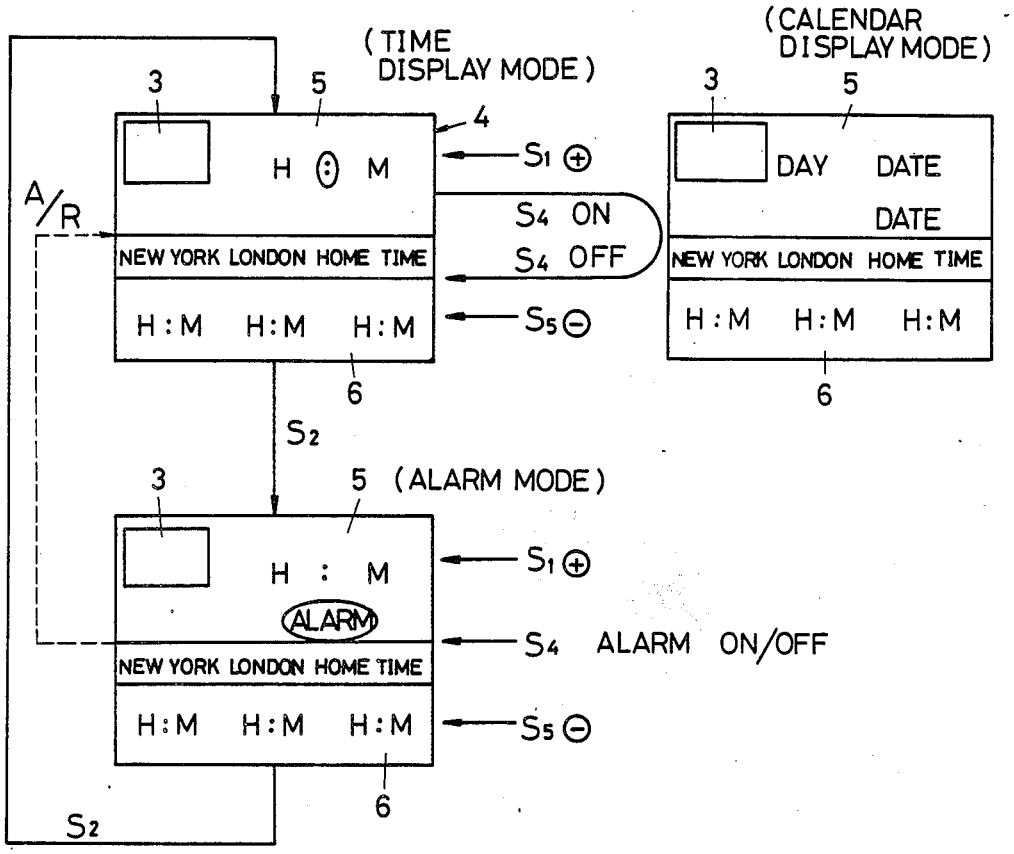
FIG. 5 is an illustration showing mode selection operations.
Figure 6:
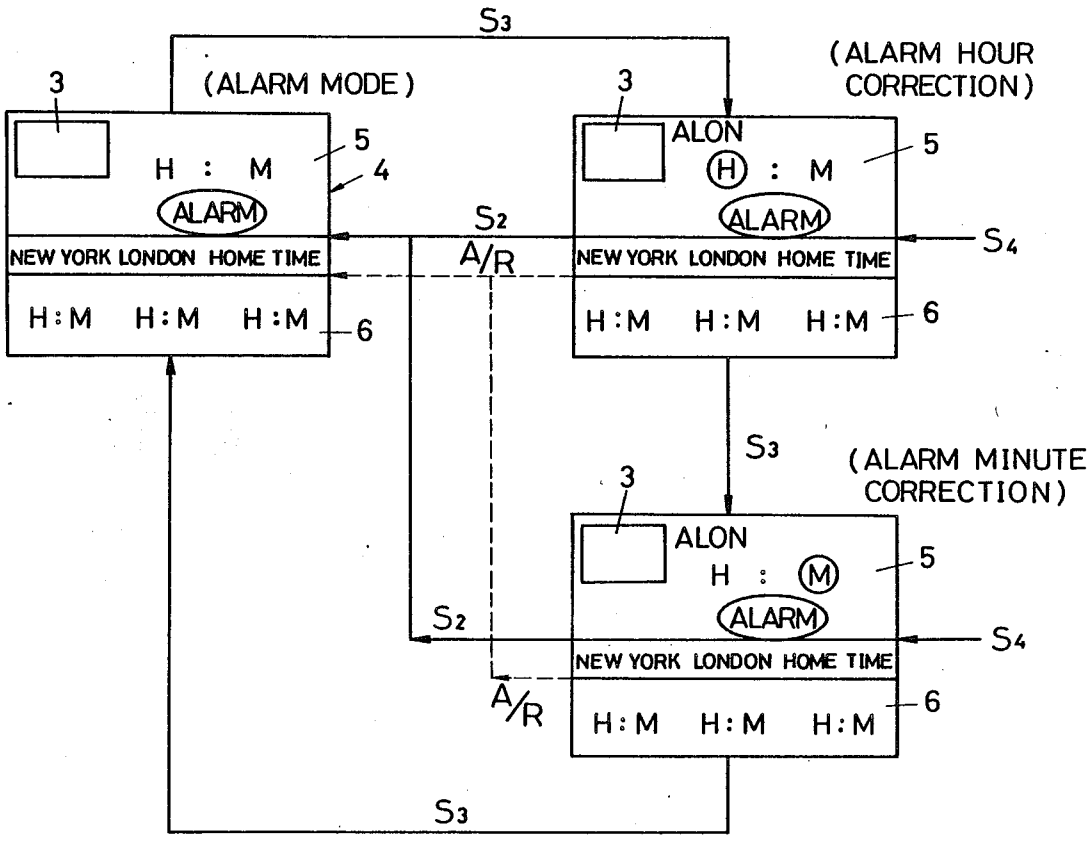
FIG. 6 is an illustration showing correction operations in an alarm mode; and FIGS. *7a* and *7b* are illustrations showing correction operations in a time display mode.
Figure 7A:
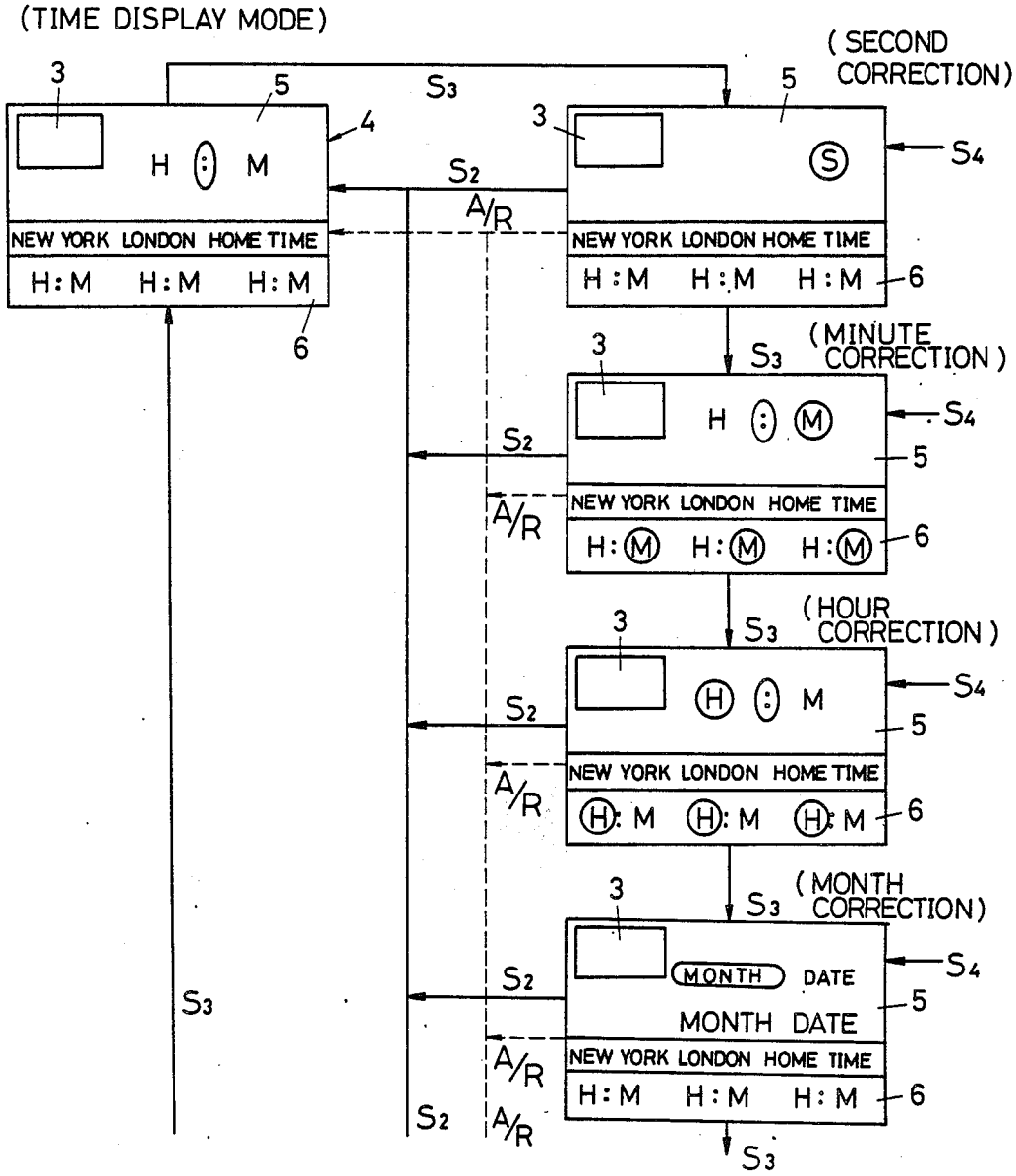
Figure 7B:
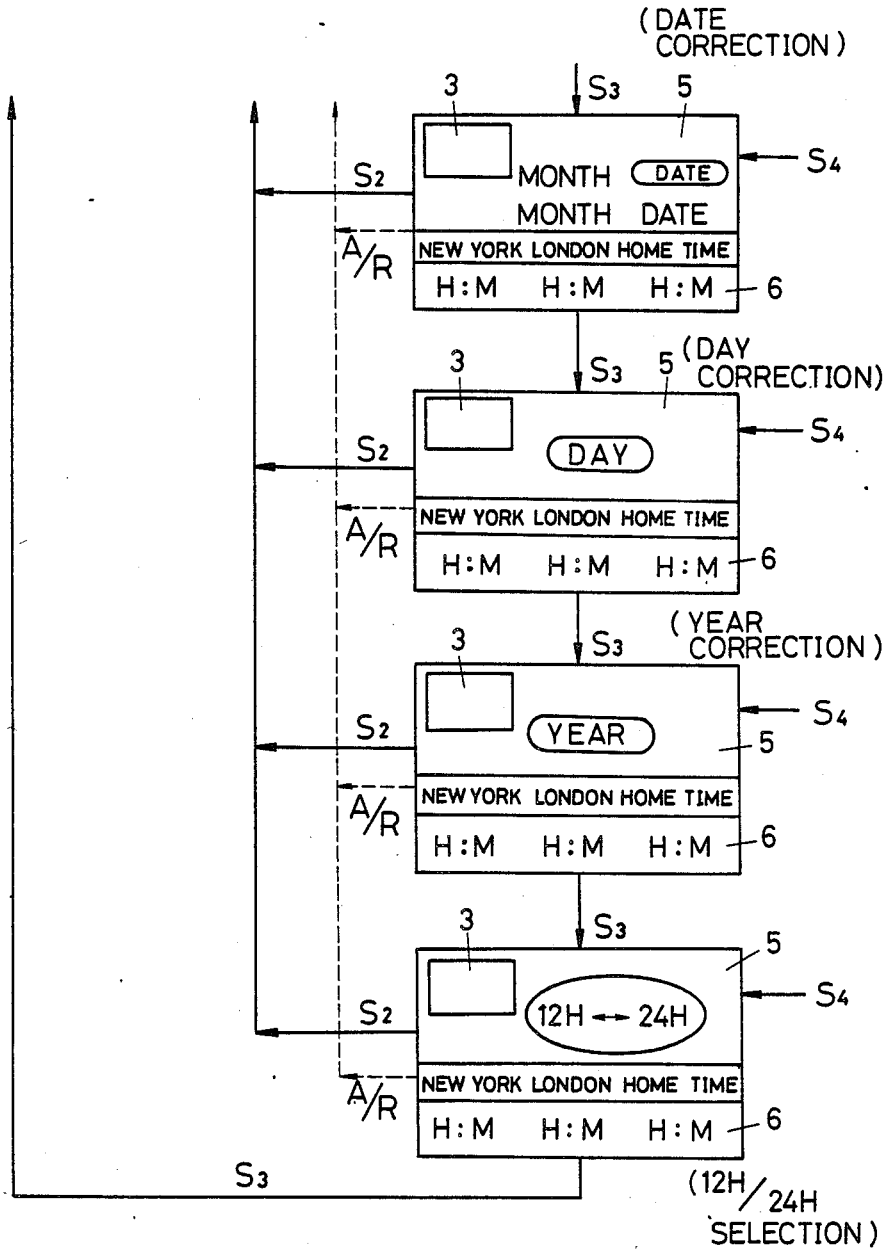

Referring to FIGS. 5 to 7 showing operations of the switch buttons, in the world time display mode of FIG. 5, when the time-difference increasing button S1 is pushed, the number indicated in the time zone display 3 is increased one by one, and correspondingly, the time displayed in the time display 5 is changed to indicate the time of a corresponding place. Similarly, when the time-difference decreasing button S5 is pushed, the number indicated in the time zone display 3 decreases. For example, if the time zone display 3 indicates +9, the time display 5 indicates the time of TOKYO since the list 12 shows that the time-difference of TOKYO is +9. If the user wants to know the time of BANGKOK, the time-difference decreasing button S5 is depressed twice. As a result, the display of the time zone display 3 is changed to +7 and the time of BANGKOK is displayed in the time display 5. Thus, the time of a desired place is displayed in the time display 5 by operating the buttons S1 or S5.

In a time display mode, when the mode select button S2 and the correction button S4 are simultaneously depressed, the time displayed in the time display 5 of the world time display panel 4 and the time displayed in the HOME TIME display section of the display panel 6 are interchanged. For example, if the time-difference +9 is selected by operating the button S1 or S5 to indicate the time of TOKYO in the time display 5 and then the buttons S2 and S4 are pushed at the same time, the time of TOKYO is indicated in the HOME TIME display section.

In FIGS. 5 to 7, each circle means that the display flashes at 1 Hz during display.

As shown in FIG. 5, when the calendar display button S4 is pushed in the time display mode, the mode is changed into a calendar display mode. Thus, the hour and the minute display are changed to a day of the week and a date display during the depression of the calendar display button S4.

In order to change the time display mode into an alarm mode or vice versa, mode select button S2 is depressed. When the correction button S4 is pushed in the alarm mode, an alarm set becomes either ON or OFF. If none of buttons are operated for two minutes or more after the pushing of the button S4, the alarm mode is automatically changed back into the time display mode as shown by the dashed line A/R of FIG. 5.

FIG. 6 shows correcting operations in the alarm mode. When the figure select button S3 is depressed for one second or more, the display of hour begins to flash. Then the correction button S4 is pushed to correct the hour. Next, the figure select button S3 is pushed again, the minute flashes. By pushing the correction button 34, the minute is corrected.

FIGS. *7a* and *7b* show correcting operations in the time display mode. As the figure select button S3 is depressed for one second or more, the time display mode is changed into a correction mode. The hour and the minute displays are changed into a second display with flashing a display of the second. When the correction button S4 is pushed, the second display is changed to "0" (zero). Then the select button S3 is pushed, the hour and the minute are displayed and the minute display flashes. At the same time, all of the minute displays in the principal city time display panel 6 also flash. Then, the correction button S4 is pushed to correct the minute display. Similarly, if the select button S3 is pushed next, the display of the hour can be corrected. Further, in the same manner, the month, date, day and year can be changed, and last of all, either a 12-hour display or 24-hour display can be selected.

In order to compensate for daylight saving time, an arrow 16 as a time shift mark is printed between time-difference prints as shown in FIG. 1. The daylight saving time is practiced in zones indicated by time-differences of 0, +1, +2, +3, +10, −9, −8, −7, −6 and −5 of FIG. 1. For example, the daylight saving time of LONDON is the time shifted by time-difference of +1 according to the arrow 16 (that is, the standard time of PARIS).

Although the place name list is disposed around the liquid crystal display device 2, the list 12 may be disposed around the world map 14.

From the foregoing, it will be understood that the present invention provides a portable world time watch in which times of various places are easy to find.

While the invention has been described in conjuction with preferred specific embodiments thereof, it will be understood that this description is intended to illustrate and not limit the scope of the invention, which is defined by the following claims.

What is claimed is:

1. A world time watch comprising:

a liquid crystal display device including a time zone display and a time display the time zone display being provided to display the time difference between a selected place and the Greewich Mean Time;

the time display being provided to display the time of the place corresponding to the time difference displayed in the time zone display;

a printed place name list including a plurality of place names and a plurality of numbers each of which represents the time difference of a corresponding place; and a printed world map.

2. The world time watch according to claim 1 wherein the place name list is provided around the liquid crystal display device.

3. The world time watch according to claim 1 wherein the numbers of the place name list include marks for indicating the shifting of time in accordance with the daylight saving time.

4. The world time watch according to claim 1 wherein the world map includes printed numbers, each representing the corresponding time difference of a particular place.

5. The world time watch according to claim 1 wherein the liquid crystal display device includes a principal city time display.

* * * * *